US010783896B2

(12) United States Patent
Makinen et al.

(10) Patent No.: US 10,783,896 B2
(45) Date of Patent: Sep. 22, 2020

(54) APPARATUS, METHODS AND COMPUTER PROGRAMS FOR ENCODING AND DECODING AUDIO SIGNALS

(71) Applicant: Nokia Technologies Oy, Espoo (FI)

(72) Inventors: Toni Henrik Makinen, Pirkkala (FI); Mikko Tapio Tammi, Tampere (FI); Miikka Tapani Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/407,392

(22) Filed: Jan. 17, 2017

(65) Prior Publication Data

US 2017/0213565 A1 Jul. 27, 2017

(30) Foreign Application Priority Data

Jan. 27, 2016 (GB) ..... 1601489.6

(51) Int. Cl.
*H04R 3/00* (2006.01)
*H04S 7/00* (2006.01)
(Continued)

(52) U.S. Cl.
CPC ..... *G10L 19/167* (2013.01); *G10L 19/008* (2013.01); *G10L 19/0204* (2013.01);
(Continued)

(58) Field of Classification Search
CPC . G10L 19/167; G10L 19/008; G10L 19/0204; G10L 21/0208; H04R 3/005;
(Continued)

(56) References Cited

U.S. PATENT DOCUMENTS 9,111,542 B1 8/2015 Hart et al.
9,521,486 B1 * 12/2016 Barton ..... H04R 3/005
(Continued)

FOREIGN PATENT DOCUMENTS

CN 101960865 A 1/2011
CN 102421050 A 4/2012
(Continued)

OTHER PUBLICATIONS

"Filterbanks and transforms", Department of Signal Processing and Tampere University of Technology, Retrieved on Jan. 18, 2017, Webpage available at : http://www.cs.tut.fi/~sgn14006/PDF/L07-filterbanks.pdf.

(Continued)

*Primary Examiner* — Vivian C Chin
*Assistant Examiner* — Ubachukwu A Odunukwe
(74) *Attorney, Agent, or Firm* — Alston & Bird LLP

(57) ABSTRACT

A method, apparatus and computer program wherein the method comprises: obtaining a beamforming signal using respective signals from a first microphone and a second microphone; reducing the data size of the beamforming signal by grouping the beamforming signal into frequency bands and obtaining a data value for each of the frequency bands; and forming a bit stream comprising at least the reduced size beamforming signal and the signal from the first microphone wherein the bit stream enables parameters of a beamed audio channel to be controlled.

20 Claims, 6 Drawing Sheets

(51) Int. Cl.
*G10L 19/16* (2013.01)
*G10L 19/008* (2013.01)
*G10L 19/02* (2013.01)

(52) U.S. Cl.
CPC ..... *H04R 3/005* (2013.01); *H04R 2430/01* (2013.01); *H04R 2430/03* (2013.01); *H04R 2430/20* (2013.01); *H04R 2499/11* (2013.01); *H04S 7/30* (2013.01); *H04S 2400/13* (2013.01); *H04S 2400/15* (2013.01)

(58) Field of Classification Search
CPC ..... H04R 2430/01; H04R 1/406; H04S 7/30; H04S 2400/13; H04S 7/302; G01S 3/8083
USPC ..... 381/92, 22, 63, 23.1, 71.8, 66, 303; 704/235
See application file for complete search history.

(56) References Cited

U.S. PATENT DOCUMENTS

2006/0147054 A1* 7/2006 Buck ..... H04R 3/005 381/92
2011/0002469 A1* 1/2011 Ojala ..... H04S 7/30 381/22
2011/0119055 A1 5/2011 Lee et al.
2011/0129095 A1* 6/2011 Avendano ..... H04R 3/005 381/63
2012/0070015 A1 3/2012 Oh et al.
2012/0076304 A1 3/2012 Suzuki
2012/0082322 A1* 4/2012 van Waterschoot ..... H04S 7/30 381/92
2012/0128166 A1 5/2012 Kim et al.
2012/0128174 A1 5/2012 Tammi et al.
2013/0044884 A1 2/2013 Tammi et al.
2013/0129100 A1* 5/2013 Sorensen ..... H04R 3/005 381/66
2014/0010373 A1* 1/2014 Gran ..... H04R 25/50 381/23.1
2014/0105416 A1 4/2014 Huttunen et al.
2014/0362253 A1* 12/2014 Kim ..... H04N 5/262 348/231.4
2014/0376741 A1* 12/2014 Kechichian ..... G01S 3/8083 381/92
2015/0063590 A1* 3/2015 Katagiri ..... H04R 1/406 381/92
2015/0078571 A1* 3/2015 Kurylo ..... G10K 11/178 381/71.8
2015/0088500 A1* 3/2015 Conliffe ..... G02C 11/10 704/235
2015/0296319 A1* 10/2015 Shenoy ..... H04S 7/302 381/303
2016/0044410 A1 2/2016 Makinen et al.
2017/0287499 A1* 10/2017 Duong ..... G10L 21/0208
2018/0122399 A1* 5/2018 Janse ..... G10L 21/0208
2018/0359560 A1* 12/2018 Defraene ..... H04R 1/406

FOREIGN PATENT DOCUMENTS

CN 103181192 A 6/2013
CN 103531203 A 1/2014
CN 103873977 A 6/2014
EP 2081189 A1 7/2009
EP 2562752 A1 2/2013
TW 201143475 A 12/2011
WO 2014/167165 A1 10/2014

OTHER PUBLICATIONS

"The Bark Frequency Scale", Stanford.Edu, Retrieved on Jan. 18, 2017, Webpage available at : https://ccrma.stanford.edu/~jos/bbt/Bark_Frequency_Scale.html.
"Spatial audio coding format", Nokia White Paper, Oct. 28, 2014, 10 pages.
Search Report received for corresponding United Kingdom Patent Application No. 1601489.6, dated Jun. 24, 2016, 3 pages.
Extended European Search Report received for corresponding European Patent Application No. 17152767.4, dated Jun. 12, 2017, 4 pages.
Office Action for European Application No. 17 152 767.4 dated Feb 25, 2019, 3 pages.
*Nokia Spatial Audio Coding Format* , White Papar, Nokia Corporation (Oct. 28, 2014) 10 pages.
Intention to Grant for European Application No. 17152767.4; dated Jan. 2, 2020, 66 pages.
Office Action for Chinese Application No. 201710061191.6, dated Feb. 6, 2020, 29 pages.

* cited by examiner

APPARATUS, METHODS AND COMPUTER PROGRAMS FOR ENCODING AND DECODING AUDIO SIGNALS

TECHNOLOGICAL FIELD

Examples of the disclosure relate to an apparatus, methods and computer programs for encoding and decoding audio signals. In particular they relate to apparatus, methods and computer programs for encoding and decoding audio signals so as to enable beamed audio channels to be rendered.

BACKGROUND

Apparatus which enable spatial audio signals to be recorded and encoded for later playback are known. It may be advantageous to enable beamforming signals to be incorporated into such signals. The beamforming signals may comprise information which enables beamed audio channels to be rendered.

BRIEF SUMMARY

According to various, but not necessarily all, examples of the disclosure there is provided a method comprising: obtaining a beamforming signal using respective signals from a first microphone and a second microphone; reducing the data size of the beamforming signal by grouping the beamforming signal into frequency bands and obtaining a data value for each of the frequency bands; and forming a bit stream comprising at least the reduced size beamforming signal and the signal from the first microphone wherein the bit stream enables parameters of a beamed audio channel to be controlled.

In some examples the bit stream may also comprise a signal received from a third microphone. The first microphone and the third microphone may be positioned towards different ends of an electronic device. The method may comprise obtaining a further beamforming signal using respective signals from the third microphone and another microphone and reducing the date size of the further beamforming signal by grouping the beamforming signal into frequency bands and obtaining a data value for each of the frequency bands; and adding the further reduced size beamforming signal to the bit stream to enable a stereo output to be provided.

In some examples the number of frequency bands within the reduced size beamforming signals may be less than the number of samples within the signal received from the first microphone.

In some examples different sized frequency bands may be used for different parts of a frequency spectrum within the reduced size beamforming signals. The frequency bands for low frequencies may be narrower than the frequency bands for high frequencies.

In some examples the bit stream may be formed by adding at least one reduced size beamforming signal as metadata to the signal received from the first microphone.

In some examples the obtained beamforming data may comprise the difference between an audio channel obtained by the first microphone and a beamed audio channel. The data value for each of the frequency bands in the reduced size beamforming signal may comprise the mean of the difference between an audio channel obtained by the first microphone and a beamed audio channel for the frequency band.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to perform; obtaining a beamforming signal using respective signals from a first microphone and a second microphone; reducing the data size of the beamforming signal by grouping the beamforming signal into frequency bands and obtaining a data value for each of the frequency bands; and forming a bit stream comprising at least the reduced size beamforming signal and the signal from the first microphone wherein the bit stream enables parameters of a beamed audio channel to be controlled.

In some examples the bit stream may also comprise a signal received from a third microphone. The first microphone and the third microphone may be positioned towards different ends of an electronic device. The memory circuitry and processing circuitry may be configured to enable obtaining a further beamforming signal using respective signals from the third microphone and another microphone and reducing the date size of the further beamforming signal by grouping the beamforming signal into frequency bands and obtaining a data value for each of the frequency bands; and adding the further reduced size beamforming signal to the bit stream to enable a stereo output to be provided.

In some examples the number of frequency bands within the reduced size beamforming signal may be less than the number of samples within the signal received from the first microphone.

In some examples different sized frequency bands may be used for different parts of a frequency spectrum within the reduced size beamforming signal. The frequency bands for low frequencies may be narrower than the frequency bands for high frequencies.

In some examples the bit stream may be formed by adding at least one reduced size beamforming signal as metadata to the signal received from the first microphone.

In some examples the obtained beamforming data comprises the difference between an audio channel obtained by the first microphone and a beamed audio channel. The data value for each of the frequency bands in the reduced size beamforming signal may comprise the mean of the difference between an audio channel obtained by the first microphone and a beamed audio channel for the frequency band.

According to various, but not necessarily all, examples of the disclosure there may be provided an electronic device comprising an apparatus as described above.

According to various, but not necessarily all, examples of the disclosure there may be provided a computer program comprising computer program instructions that, when executed by processing circuitry, enables: obtaining a beamforming signal using respective signals from a first microphone and a second microphone; reducing the data size of the beamforming signal by grouping the beamforming signal into frequency bands and obtaining a data value for each of the frequency bands; and forming a bit stream comprising at least the reduced size beamforming signal and the signal from the first microphone wherein the bit stream enables parameters of a beamed audio channel to be controlled.

According to various, but not necessarily all, examples of the disclosure there may be provided a computer program comprising program instructions for causing a computer to perform any of the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, examples of the disclosure there may be provided a method comprising: obtaining a bit stream comprising at least a reduced size beamforming signal and a signal from a first microphone; and decoding the bit stream to obtain a first audio channel corresponding to the signal obtained from the first microphone and a beamed audio channel wherein the bit stream enables parameters of a beamed audio channel to be controlled.

In some examples the obtained bit stream may also comprises a signal received from a third microphone and the method may also comprise decoding the signal received from the third microphone to enable a spatial audio output to be rendered.

In some examples the obtained bit stream may also comprise a further reduced size beamforming signal to enable a stereo output to be provided.

In some examples the number of frequency bands within the reduced size beamforming signals may be less than the number of samples within the signal from the first microphone.

In some examples the reduced size beamforming signals may comprise information indicative of a difference between an audio channel obtained by the first microphone and a beamed audio channel.

In some examples the data value for each of the frequency bands in the reduced size beamforming signal comprises the mean of the difference between an audio channel obtained by the first microphone and a beamed audio channel for the frequency band.

In some examples the method comprises detecting a user input selecting a focus position for an audio output and adjusting the rendered audio output to correspond to the selected focus position. The method may comprise storing the rendered audio output signal corresponding to the selected focus position.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to perform; obtaining a bit stream comprising at least a reduced size beamforming signal and a signal from a first microphone; and decoding the bit stream to obtain a first audio channel corresponding to the signal obtained from the first microphone and a beamed audio channel wherein the bit stream enables parameters of a beamed audio channel to be controlled.

In some examples the obtained bit stream may also comprise a signal received from a third microphone and the method comprises decoding the signal received from the third microphone to enable a spatial audio signal to be rendered.

In some examples the obtained bit stream may also comprise a further reduced size beamforming signal to enable a stereo output to be provided.

In some examples the number of frequency bands within the reduced size beamforming signals may be less than the number of samples within the signal from the first microphone.

In some examples the reduced size beamforming signal may comprise the information indicative of a difference between an audio channel obtained by the first microphone and a beamed audio channel.

In some examples the data value for each of the frequency bands in the reduced size beamforming signal may comprise the mean of the difference between an audio channel obtained by the first microphone and a beamed audio channel for the frequency band.

In some examples the memory circuitry and processing circuitry may also be configured to enable detecting a user input selecting a focus position for an audio output and adjusting the rendered audio output to correspond to the selected focus position. The memory circuitry and processing circuitry may also be configured to enable storing the rendered audio output signal corresponding to the selected focus position.

According to various, but not necessarily all, examples of the disclosure there may be provided an electronic device comprising an apparatus as described above.

According to various, but not necessarily all, examples of the disclosure there may be provided a computer program comprising computer program instructions that, when executed by processing circuitry, enables: obtaining a bit stream comprising at least a reduced size beamforming signal and a signal from the first microphone; and decoding the bit stream to obtain the first audio channel corresponding to the signal obtained from the first microphone and a beamed audio channel wherein the bit stream enables parameters of a beamed audio channel to be controlled.

According to various, but not necessarily all, examples of the disclosure there may be provided an computer program comprising program instructions for causing a computer to perform any of the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
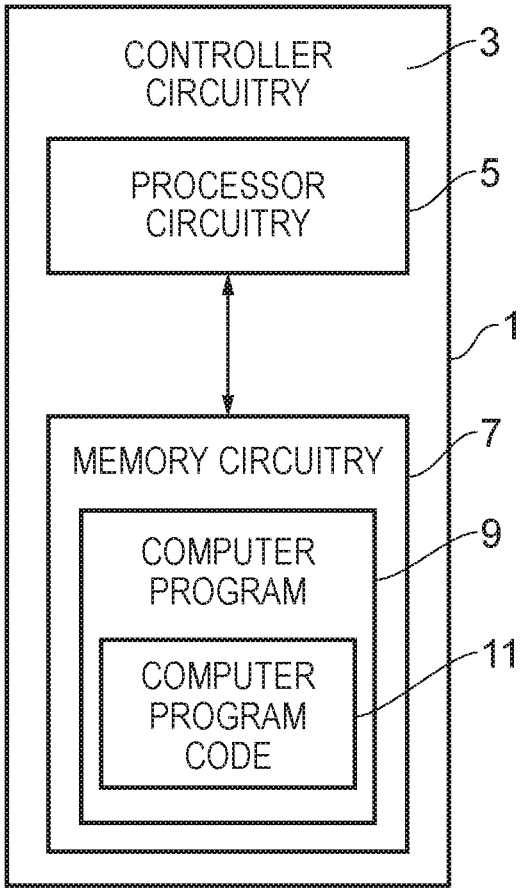
FIG. 1 illustrates an apparatus.

The Figures illustrate example methods, apparatus 1 and computer programs 9. In some examples the method comprises obtaining a beamforming signal using respective signals from a first microphone 41 and a second microphone 43; reducing the data size of the beamforming signal by grouping the beamforming signal into frequency bands and obtaining a data value for each of the frequency bands; and forming a bit stream 57 comprising at least the reduced size beamforming signal and the signal from the first microphone 41 wherein the bit stream enables parameters of a beamed audio channel to be controlled.

In such examples the apparatus 1 may be for encoding an audio signal. The encoded audio signal may comprise a beamforming audio signal or a reduced size beamforming signal. The beamforming audio signal or reduced size beamforming signal may comprise information which enables a beamed audio channel to be provided. The beamed audio channel may be used for any suitable audio focus application.

In some examples the method may comprise; obtaining a bit stream 57 comprising at least a reduced size beamforming signal and a signal from a first microphone 41; and decoding the bit stream 57 to obtain a first audio channel corresponding to the signal obtained from the first microphone 41 and a beamed audio channel wherein the bit stream enables parameters of a beamed audio channel to be controlled.

In such examples the apparatus 1 may be for decoding an audio signal. Once the signal has been decoded the apparatus 1 may enable a beamed audio channel to be rendered. A user may be able to control the focus position of the beamed audio channel.

FIG. 1 schematically illustrates an example apparatus 1 which may be used in implementations of the disclosure. The apparatus 1 illustrated in FIG. 1 may be a chip or a chip-set. In some examples the apparatus 1 may be provided within an electronic device 21, 31 such as a mobile phone or television or any other suitable electronic device 21, 31. In some examples the apparatus 1 could be provided within a device which captures and encodes an audio signal such as the example electronic device 21 in FIG. 2. In some examples the apparatus 1 could be provided within an electronic device which receives the encoded signal and enable the encoded signal to be decoded for rendering by a loudspeaker or headphones, such as the example electronic device 31 in FIG. 3.

The example apparatus 1 comprises controlling circuitry 3. The controlling circuitry 3 may provide means for controlling an electronic device 21, 31. The controlling circuitry 3 may also provide means for performing the methods or at least part of the methods of examples of the disclosure.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods illustrated in FIGS. 5A and 5B and 6A and 6B. The processing circuitry 5 by reading the memory circuitry 7 is able to load and execute the computer program 9.

In some examples the computer program 9 may comprise an audio capture application. The audio capture application may be configured to enable an apparatus 1 to capture audio signals and enable the captured audio signals to be encoded for playback. The apparatus 1 therefore comprises: processing circuitry 5; and memory circuitry 7 including computer program code 11, the memory circuitry 7 and computer program code 11 configured to, with the processing circuitry 5, cause the apparatus 1 at least to perform: obtaining a beamforming signal using respective signals from a first microphone 41 and a second microphone 43; reducing the data size of the beamforming signal by grouping the beamforming signal into frequency bands and obtaining a data value for each of the frequency bands; and forming a bit stream 57 comprising at least the reduced size beamforming signal and the signal from the first microphone 41 wherein the bit stream 57 enables parameters of a beamed audio channel to be controlled. Such apparatus 1 may be provided in electronic devices 21 arranged to receive and encode audio signals.

In some examples the computer program 9 may comprise an audio reproduction application. The audio reproduction application may be configured to enable example methods of the disclosure to be performed by an apparatus 1. The audio reproduction application may enable an apparatus 1 to obtain encoded audio signals and decode the obtained signals for playback. The apparatus 1 therefore comprises: processing circuitry 5; and memory circuitry 7 including computer program code 11, the memory circuitry 7 and the computer program code 11 configured to, with the processing circuitry 5, cause the apparatus 1 at least to perform: obtaining a bit stream 57 comprising at least a reduced size beamforming signal and a signal from a first microphone 41; and decoding the bit stream 57 to obtain the first audio channel corresponding to the signal obtained from the first microphone 41 and a beamed audio channel wherein the bit stream 57 enables parameters of a beamed audio channel to be controlled. Such apparatus may be provided in electronic devices 31 arranged to decode and render audio signals.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus may propagate or transmit the computer program 9 as a computer data signal. In some examples the computer program code 11 may be transmitted to the apparatus 1 using a wireless protocol such as Bluetooth, Bluetooth Low Energy, Bluetooth Smart, 6LoWPan (IP$_v$6 over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 2:
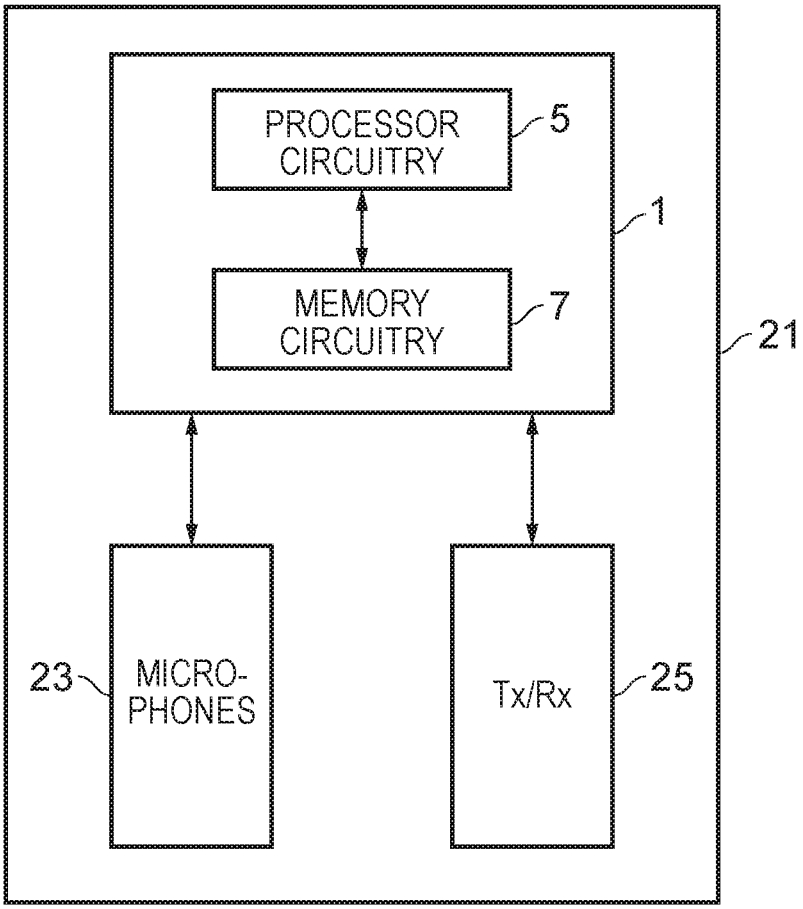
FIG. 2 illustrates an electronic device comprising an apparatus.

FIG. 2 schematically illustrates an example electronic device 21. The example electronic device 21 of FIG. 2 may be configured to enable an audio signal to be recorded and encoded. The electronic device 21 comprises an apparatus 1 as described above. Corresponding reference numerals are used for corresponding features. In addition to the apparatus 1 the example electronic device 21 of FIG. 2 also comprises a plurality of microphones 23 and one or more transceivers 25. The electronic device 21 may comprise other features which are not illustrated in FIG. 2 such as, a power source or any other suitable features.

The plurality of microphones 23 may comprise any means which enable an audio signal to be recorded. The plurality of microphones 23 may comprise any means which may be configured to convert an acoustic input signal to an electrical output signal. The plurality of microphones 23 may be coupled to the apparatus 1 to enable the apparatus 1 to process audio signals recorded by the plurality of microphones 23. In some examples the apparatus 1 may process the audio signals by encoding the received audio signal.

The plurality of microphones 23 may be located at any suitable position within the electronic device 21. In some examples different microphones 23 may be located at different positions within the electronic device 21 to enable a spatial audio signal to be recorded.

The different microphones 23 may be positioned so as to enable a beamforming audio signal to be obtained. The beamforming audio signal is a signal which comprises information which enables a beamed audio channel to be rendered. To obtain a beamforming signal at least two input microphone signals are detected from different microphones 23. The detected input signals may be provided to the apparatus 1. The apparatus 1 may be configured to combine the two or more input signals to obtain the information needed to produce a beamed audio channel. At least one of the input microphone signals is processed before being combined with the other input microphone signal. For instance, in some examples, one of the input microphone signals may be delayed before being summed with one or more other input microphone signals. The apparatus 1 may be configured to obtain the beamforming signal before the audio signal is encoded. This ensures that the decoder is able to retrieve the beamforming information from the beamforming signal.

The one or more transceivers 25 may comprise one or more transmitters and/or receivers. The one or more transceivers 25 may comprise any means which enables the electronic device 21 to establish a communication connection with another electronic device and exchange information with the another electronic device. The communication connection may comprise a wireless connection.

In some examples the one or more transceivers 25 may enable the apparatus 1 to connect to a network such as a cellular network. In some examples the one or more transceivers 25 may enable the apparatus 1 to communicate in local area networks such as wireless local area networks, Bluetooth networks or any other suitable network.

The one or more transceivers 25 may be coupled to the apparatus 1 within the electronic device 21. The one or more transceivers 25 may be configured to receive signals from the apparatus 1 to enable the signals to be transmitted. The apparatus 1 may be configured to provide encoded audio signals to the one or more transceivers 25 to enable the encoded audio signals to be transmitted to the another electronic device.

Figure 3:
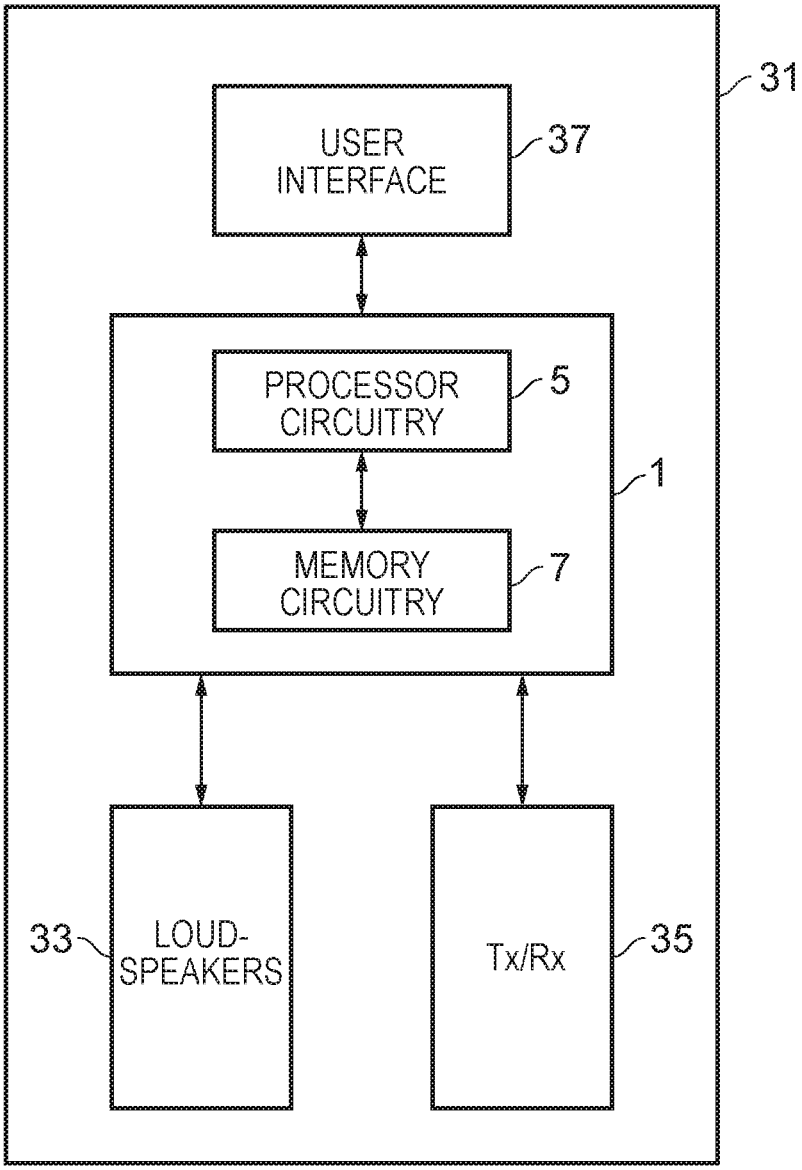
FIG. 3 illustrates an electronic device comprising another apparatus.

FIG. 3 schematically illustrates another electronic device 31 comprising another apparatus 1. The example electronic device 31 of FIG. 3 may be configured to enable an encoded audio signal to be decoded and rendered for playback to a user. The electronic device 31 comprises an apparatus 1 as described above. Corresponding reference numerals are used for corresponding features. In addition to the apparatus 1 the example electronic device 31 of FIG. 3 also comprises a plurality of loudspeakers 33, one or more transceivers 35 and a user interface 37. The electronic device 31 may comprise other features which are not illustrated in FIG. 3 such as, a power source, headphones or any other suitable features.

The plurality of loudspeakers 33 may comprise any means which enables an audio output channel to be rendered. The plurality of loudspeakers 33 may comprise any means which may be configured to convert an electrical input signal to an acoustic output signal. The plurality of loudspeakers 33 may be positioned within the electronic device 31 so as to enable spatial audio output channels to be provided. The plurality of loudspeakers 33 may be configured to enable beamed audio channels to be provided.

The plurality of loudspeakers 33 may be coupled to the apparatus such that the loudspeakers 33 receive an input signal from the apparatus 1. The loudspeakers 33 may then convert the received input signal to an audio channel.

The one or more transceivers 35 may comprise one or more transmitters and/or receivers. The one or more transceivers 35 may comprise any means which enables the electronic device 31 to establish a communication connection with another electronic device and exchange information with the another electronic device. The another electronic device could be a recording electronic device 21 as described above. The communication connection may comprise a wireless connection.

In some examples the one or more transceivers 35 may enable the apparatus to connect to a network such as a cellular network. In some examples the one or more transceivers 35 may enable the apparatus 1 to communicate in local area networks such as wireless local area networks, Bluetooth networks or any other suitable network.

The one or more transceivers 35 may be coupled to the apparatus 1 within the electronic device 31. The one or more transceiver 35 may be configured to receive encoded acoustic signals from another device and enable the encoded signal to be provided to the apparatus 1. The apparatus 1 may be configured to decode the received signals and provide the decoded signals to the plurality of loudspeakers 35 to enable an audio output channel to be rendered.

In some examples the electronic device 31 may also comprise a user interface 37. The user interface 37 may comprise any means which enable a user to interact with the electronic device 31. In some examples the user interface 37 may comprise user input means such as a touch sensitive display or any other suitable means which may enable a user to make user inputs. For instance the user interface 37 may be configured to enable a user to make a user input to select a setting for audio output channel. This may enable a user to select a spatial audio setting and/or select a focus for a beamed channel. The apparatus 1 may be configured to control the output signal provided to the loudspeakers 33 in response to the user input.

In the examples described above the electronic device 21 which records the acoustic signal is different to the electronic device 31 which renders the acoustic signal. This may enable the acoustic signal to be shared between different users. In some examples the same electronic device may be configured to both record the acoustic signal and render the acoustic signal. In such examples once the apparatus 1 has encoded the signal obtained by the microphones 23 it may be stored in the memory circuitry 5 of the apparatus 1 and may be accessed for later playback.

Figure 4:
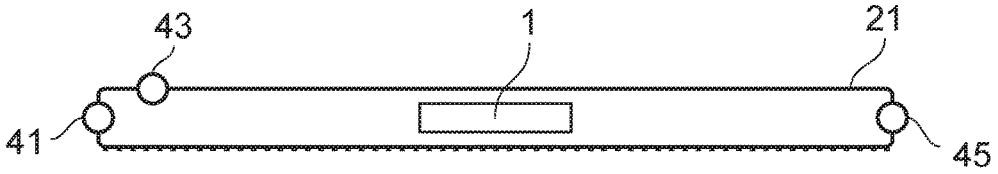
FIG. 4 illustrates an example electronic device.

FIG. 4 illustrates a cross section through an example electronic device 21 which may be used to implement some examples of the disclosure. The example electronic device 21 in FIG. 4 may be arranged to record a spatial audio signal. In some examples the electronic device 21 may be arranged to record the acoustic signal and also render the acoustic audio signal as play back for the user. In the examples of FIG. 4 the electronic device 21 may be a mobile phone. Other types of electronic devices 21, 31 may be used in other examples of the disclosure.

The electronic device 21 comprises a plurality of microphones 23 as described above. In the example of FIG. 4 the electronic device 21 comprises a first microphone 41, a second microphone 43 and a third microphone 45.

The first microphone 41 may be configured to capture a left audio channel and the third microphone 45 may be configured to capture a right audio channel. The first microphone 41 and the third microphone 45 may enable spatial audio signals to be captured. The first microphone 41 and the third microphone 45 are located towards opposite ends of the electronic device 21. In other examples the microphones 41, 45 may be positioned in other locations.

The second microphone 43 is located in a different position to the first microphone 41 and the third microphone 45. In the example of FIG. 4 the second microphone is located on a rear surface of the electronic device 21. Where the electronic device 21 is a mobile telephone the rear surface may be the opposite surface to the display. In the example of FIG. 4 the second microphone 43 is positioned towards the first end of the electronic device 21 so that the second microphone 43 is positioned closer to the first microphone 41 than to the third microphone 45. It is to be appreciated that other numbers and arrangements of microphones 41, 43, 45 may be used in other examples of the disclosure.

The second microphone 43 may be configured to detect a second microphone signal. The second microphone signal may be combined with the signal obtained by the first microphone 41 to enable a beamforming signal to be obtained. In the example of FIG. 4 the beamforming signal obtained with the second microphone 43 and the first microphone 41 may enable a beamed left audio channel to be provided.

In some examples the second microphone 43 may be also used for other purposes in addition to enabling beamforming signals to be obtained. For instance in some examples the second microphone 43 may enable directional analysis of acoustic signals or any other suitable functions.

Figure 5A:
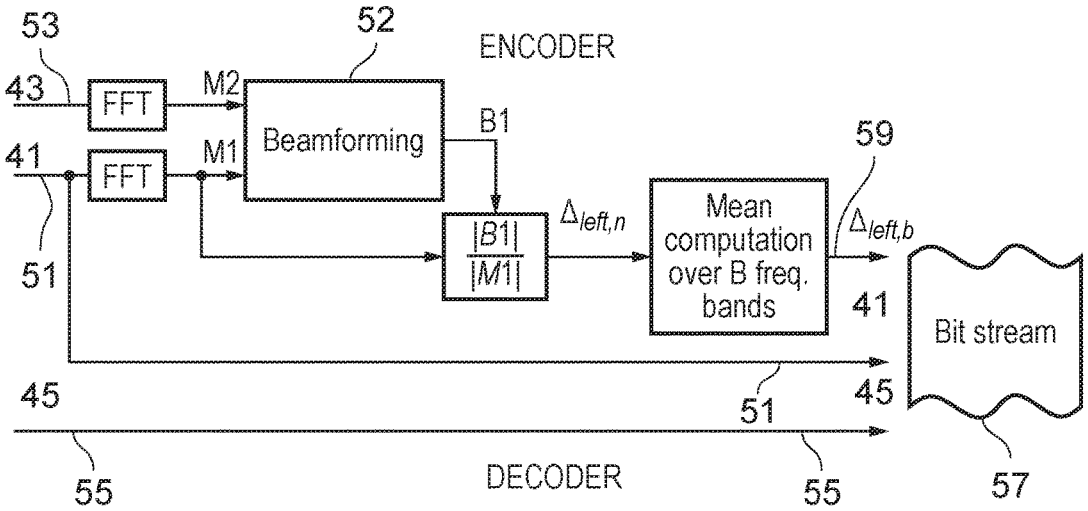
FIGS. 5A and 5B illustrate example methods
Figure 5B:
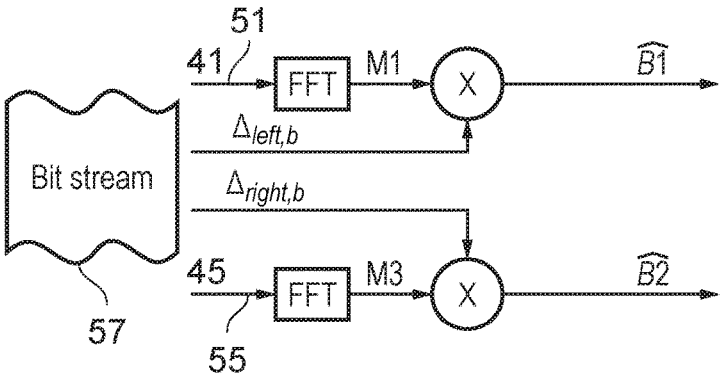

An apparatus 1 as described above may be provided within the electronic device 21. The apparatus 1 may be provided at any suitable position within the electronic device 21. The apparatus 1 may be configured to receive the electrical output signals from the microphones 41, 45 and encode the received input signals together with an obtained beamforming signal. In some examples the apparatus 1 may also enable a signal to be decoded to enable the acoustic signal to be rendered for playback to a user. FIGS. 5A and 5B illustrate example methods that could be performed by the apparatus 1 within the example electronic device 21 of FIG. 4.

FIG. 5A illustrates an example method that may be performed by an apparatus 1 when it is operating in an audio capture mode. When the apparatus 1 is operating in an audio capture mode the apparatus 1 is configured to receive the input signals from the microphones 41, 43, 45 and encode them into a bit stream 57.

In the example of FIG. 5A the apparatus 1 obtains three input signals 51, 53, 55. The first input signal 51 is obtained from the first microphone 41, the second input signal 53 is obtained from the second microphone 43 and the third input signal 55 is obtained from the third microphone 45. In the example of FIG. 5A the electronic device 21 comprises three microphones 41, 43, 45 and three input signals are obtained. In examples where the electronic device 21 comprises a different number of microphones then a different number of input signals may be obtained.

The first signal 51 may form the left audio channel and the third signal 55 may form the right audio channel. These microphone input signals may be used to form a bit stream 57. The bit stream 57 may comprise any suitable format such as AC-3 or AAC.

The second signal 53 may be obtained from the second microphone 43. The second signal 53 may be used to obtain a beamforming signal. The second signal 53 may be combined with the first signal 51 to obtain the reduced size beamforming signal 59. The reduced size beamforming signal 59 may enable a beamed left channel to be provided. In the example of FIG. 5A the second signal 53 is not added to bit stream 57. Instead the reduced size beamforming signal 59 is obtained using the second signal and the reduced size beamforming signal is used to enable control of the parameters of a beamed audio channel with only a minor increase in the amount of data in the bit stream 57.

Any suitable process may be used to obtain the reduced size beamforming signal 59. The beam forming may be performed in the frequency domain or the time domain. In the example of FIG. 5A the beam forming is performed in the frequency domain. In the method of FIG. 5A a Fourier transform of the first signal 51 is obtained from the first microphone 41 to give the transformed first signal M1 and a Fourier transform of the second signal 53 is obtained from the second microphone 43 to give the transformed second signal M2.

A beamforming process is then used on the transformed first signal M1 and transformed second signal M2 to obtain the Fourier transform of the beamed left channel B1. Any suitable process may be used on the transformed signals to obtain the Fourier transform of the beamed left channel B1.

Once the beamforming signal B1 has been obtained the difference between the original left channel and the beamed left channel is calculated for each frequency bin n within the obtained sample. The difference between the two channels is given by:

$$\Delta_{left,n} = \frac{|B1_n|}{|M1_n|},\ n = 0, \ldots, \frac{NFFT}{2} - 1,$$

where M1 is the Fourier transform of the left audio channel and B1 is the Fourier transform of the beamed left channel, |•| is the magnitude of the complex-valued frequency response at bin n, and NFFT is the length of the Fourier transform. The magnitude is computed as $$|M1_n| = \sqrt{Re\{M1_n\}^2 + \mathrm{Im}\{M^1{}_n\}^2},$$

where Re{•} and Im{•} stand for the real and imaginary parts of the corresponding frequency bin n. It is to be appreciated that other methods could be used to obtain the differences between the channels in other examples of the disclosure. For instance, in some examples a filter bank representation may be used instead of Fourier transform.

Once the difference signal $\Delta_{left,n}$ has been obtained the size of the difference signal $\Delta_{left,n}$ is reduced by grouping the difference signal $\Delta_{left,n}$ into frequency bands and obtaining a data value for each of the frequency bands to produce a reduced size beam forming signal $\Delta_{left,b}$. The number of frequency bands within the reduced size beam forming signal $\Delta_{left,b}$ is less than the number of samples within the original signal. The number of frequency bands within the reduced size beam forming signal $\Delta_{left,b}$ may be much less than the number of samples within the original signal.

Different sized frequency bands may be used for different parts of a frequency spectrum within the reduced size beam forming signal $\Delta_{left,b}$. This may enable frequency responses to be estimated more accurately for some frequency regions than for others. The level of accuracy that is used for the different frequency regions may be determined by the accuracy with which a user would perceive the different frequencies. A psychoacoustical scale such as the Bark scale may be used to select the accuracies used for the different frequency regions. In some examples the frequency bands that are used for low frequencies may be narrower than the frequency bands for high frequencies. In some examples the low frequencies may be estimated bin-by-bin, and wider frequency bands may be used for the middle and high frequencies.

In some examples, the data value for each of the frequency bands may be calculated as the mean of the difference signal over the given frequency band.

$$\Delta_b = \frac{1}{(b_h - b_l)} \sum_{n=b_l}^{b_h} \Delta_n,$$

where $b_h$ is the highest frequency bin and $b_l$ is the lowest frequency bin in a frequency band b.

As an example the number of sub-bands used in the reduced size beam forming signal $\Delta_{left,b}$, could be set to 64. This results in the number of sub-bands in the estimation being much smaller than the number of samples in the Fourier transform B1. This ensures that the amount of data within the stored or transmitted reduced size beam forming signal $\Delta_{left,b}$ is significantly reduced compared to encoding the audio signal received from the second microphone 43.

As an example the limits for each of the frequency bands could be defined as shown in the tables below (NFFT=2048).

| b | 1 | 2 | 3 | ... | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|
| $b_l$ | 1 | 2 | 3 | ... | 31 | 32 | 34 | 36 | 38 | 40 | 42 | 44 | 46 | 48 | 50 | 53 | 56 | 59 | 62 | 65 | 68 |
| $b_h$ | 2 | 3 | 4 | ... | 32 | 34 | 36 | 38 | 40 | 42 | 44 | 46 | 48 | 50 | 53 | 56 | 59 | 62 | 65 | 68 | 71 |

| b | 48 | 49 | 50 | 51 | 52 | 53 | 54 | 55 | 56 | 57 | 58 | 59 | 60 | 61 | 62 | 63 | 64 |
|---|---|---|---|---|---|---|---|---|---|---|---|---|---|---|---|---|---|
| $b_l$ | 71 | 75 | 79 | 83 | 87 | 92 | 98 | 108 | 120 | 130 | 140 | 150 | 160 | 180 | 200 | 280 | 500 |
| $b_h$ | 75 | 79 | 83 | 87 | 92 | 98 | 108 | 120 | 130 | 140 | 150 | 160 | 180 | 200 | 280 | 500 | 1024 |

Once the reduced size beam forming signal $\Delta_{left,b}$ has been obtained the reduced size beam forming signal $\Delta_{left,b}$ may be added to the bit stream 57 comprising the signals from the first microphone 41 and the third microphone 45. The reduced size beam forming signal $\Delta_{left,b}$ may be added as metadata to the bit stream 57.

The bit stream 57 may be stored in the memory circuitry 7 of the apparatus 1 and retrieved for later playback. In some examples the bit stream 57 may be transmitted to one or more other devices to enable the audio to be rendered by the one or more other devices.

In FIG. 5A a reduced size beam forming signal $\Delta_{left,b}$ for the beamed left channel is obtained. It is to be appreciated that a similar process may also be used to obtain a reduced sized beam forming signal for a beamed right channel. The reduced sized beam forming channel for a beamed right channel may also be added to the bit stream 57.

FIG. 5B illustrates an example method that may be performed by an apparatus 1 when it is operating in an audio reproduction mode. When the apparatus 1 is operating in an audio reproduction mode the apparatus 1 is configured to obtain a bit stream 57 and decode the signals from the bit stream. The decoded signals may then be provided to one or more loudspeakers 33 to enable the audio signals to be rendered. In some examples the decoded signals may be provided to headphones which enable a stereo or binaural output to be provided.

In some examples the bit stream 57 may be retrieved from memory circuitry 7. In some examples the bit stream 57 may be received from another device.

In the example of FIG. 5B the bit stream 57 comprises a first signal 51 which may form the left audio channel and a third signal 55 which may form the right audio channel. The bit stream 57 also comprises a reduced size beam forming signal $\Delta_{left,b}$ for the beamed left channel and a reduced size beam forming signal $\Delta_{right,b}$ for the beamed right channel.

In the method of FIG. 5B the bit stream 57 is decoded to obtain the beamed left channel B1 and the beamed right channel B2. To obtain the beamed left channel the Fourier transform of the left channel M1 is obtained. This is then combined with the reduced size beam forming signal $\Delta_{left,b}$ to obtain the beamed left channel $\widehat{B1}$. The beamed left channel $\widehat{B1}$ may be estimated by $$\widehat{B1}_n = M1_n \times \Delta_{left,b}$$

where $n=b_l, \ldots, b_h$ and b=1, B where B is the number of sub bands in the reduced size beam forming signal.

Similarly to obtain the beamed right channel the Fourier transform of the right channel M3 is obtained. This is then combined with the reduced size beam forming signal $\Delta_{right,b}$ to obtain the beamed right channel $\widehat{B2}$. The beamed right channel $\widehat{B2}$ may be estimated by $$\widehat{B2}_n = M3_n \times \Delta_{right,b}$$

where $n=b_l, \ldots, b_h$ and b=1, . . . , B where B is the number of sub bands in the reduced size beam forming signal.

The beamed channels $\widehat{B1}$, $\widehat{B2}$ may be used when audio focussing is used. As the bit stream 57 also comprises a first signal 51 which may form the left audio channel and a third signal 55 which may form the right audio channel this may also enable the original audio channels to be provided or may enable spatial audio outputs to be provided.

As both the original audio channels and the beamed audio channels are available within the bit stream 57 the user may choose between the original audio channels and the beamed channels. This may enable the end user to freely control if and when to apply the audio focus effect.

It is to be appreciated that other methods could be used to obtain the reduced size beam forming signal in other examples of the disclosure. For instance, in some examples the difference between an original audio channel and the beamed channel could be computed as an absolute difference rather than a ratio. In such examples
the difference signal could be also computed in frequency domain for each complex-valued frequency bin n as:

$$\Delta_n = M1_n - B1_n, n = 0, \ldots, \frac{NFFT}{2} - 1.$$

In such examples the beamed channels would then be given by:

$$\widehat{B1} = M1 - \Delta_{left,b}$$

$$\widehat{B2} = M3 - \Delta_{right,b}$$

or even $$\widehat{B1} = M1 - \Delta_{left,b}$$

$$\widehat{B2} = M3 - \Delta_{left,b}.$$

In the latter case the absolute change for the signals M1 from the first microphone 41 and the signal M3 from the third microphone 45 remains the same. This enables the decoding apparatus 1 to recreate the beamed left channel and the beamed right channel from the same reduced size beam forming signal. The same approach may be used also with relational differences. This may reduce the amount of data that needs to be transmitted and/or stored.

In some examples a combination of the ratio and the absolute differences may be used to obtain the difference signal. For instance, in some examples the absolute spectral difference could be used for some frequency subbands while a ratio could be used for other frequency subbands. This could prevent potential phase errors that may occur when applying only the left channel spectrum relational differences.

Figure 6A:
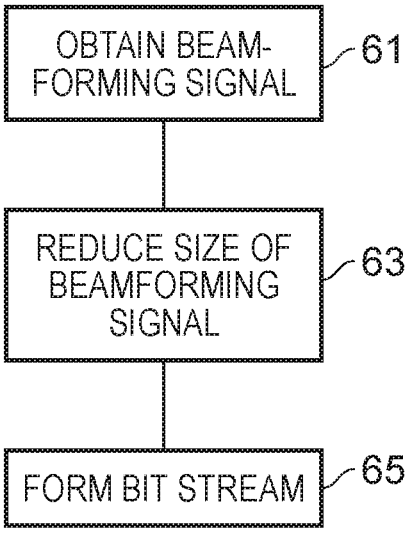
FIGS. 6A and 6B illustrate example methods.
Figure 6B:
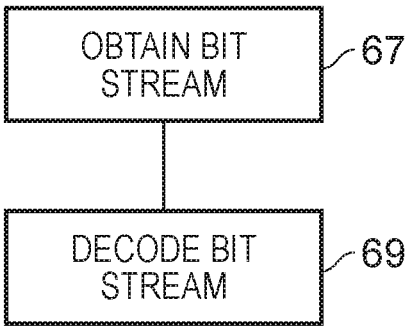

FIGS. 6A and 6B illustrate general example methods that could be performed by apparatus 1 as described above.

FIG. 6A illustrates an example method that may be performed by an apparatus 1 when it is operating in an audio capture mode. At block 61 the method comprises obtaining a beamforming signal using a signal from a first microphone 41 and a signal from a second microphone 43. Any suitable method may be used to obtain the beamforming signal. At block 63 the method comprises reducing the size of the beamforming signal by grouping the signal into frequency bands and obtaining a data value for each of the frequency bands. At block 65 the method also comprises forming a bit stream comprising at least the reduced size beamforming signal and the signal from the first microphone 41.

FIG. 6B illustrates an example method that may be performed by an apparatus 1 when it is operating in audio reproduction mode. At block 67 the method comprises obtaining a bit stream 57 comprising at least a reduced size beamforming signal and a signal from a first microphone 41. At block 69 the method comprises decoding the bit stream to obtain a first audio channel corresponding to the signal obtained from the first microphone 41 and a beamed audio channel.

Figure 7:
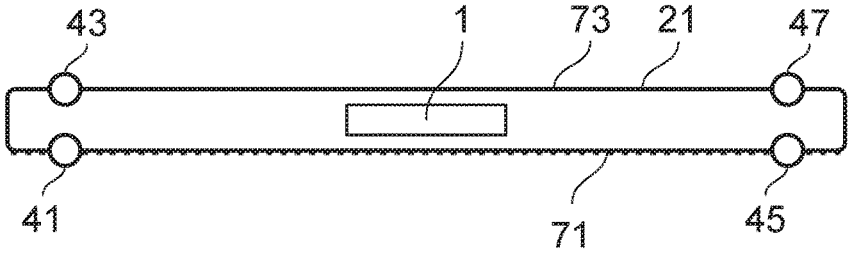
FIG. 7 illustrates an example electronic device.

FIG. 7 illustrates another example electronic device 21 which could be used to implement examples of the disclosure. FIG. 7 illustrates a cross section through an example electronic device 21 which may be used to implement some examples of the disclosure. The example electronic device 21 may be similar to the example electronic device of FIG. 4 however the microphones in the respective devices have different arrangements.

In the example of FIG. 7 the electronic device 21 comprises a first microphone 41, a second microphone 43, a third microphone 45 and a fourth microphone 47. The electronic device may also comprise an apparatus 1 as described above. The electronic device 21 may be configured to perform the methods of FIGS. 5A to 6B.

The first microphone 41 may be configured to capture a left audio channel and the third microphone 45 may be configured to capture a right audio channel. The first microphone 41 and the third microphone 45 may enable spatial audio signals to be captured. The first microphone 41 and the third microphone 45 are located on a first face 71 of the electronic device 21. The first microphone 41 and the third microphone 45 may be located towards opposite ends of the first face 71 of the electronic device 21. In examples where the electronic device 21 is a mobile telephone the first microphone 41 and the second microphone 45 may be located on the same side as the display of the mobile phone.

The second microphone 43 and the fourth microphone 47 are located on a second face 73 of the electronic device 21. The second face may be an opposing surface to the first face 71. Where the electronic device 21 is a mobile telephone the second face may be the opposite side to the display.

The second microphone 43 is positioned towards the same end of the electronic device 21 as the first microphone 41 and the fourth microphone 47 is positioned towards the same end of the electronic device as the third microphone 45.

The signals obtained by the second microphone 43 and the signals obtained by the fourth microphone 47 may enable a beamforming signal to be obtained. In the example of FIG. 7 the beamforming signal obtained with the second microphone 43 and the first microphone 41 may enable a beamed left audio channel to be provided and the beamforming signal obtained with the fourth microphone 47 and the third microphone 45 may enable a beamed right audio channel to be provided The example electronic device 21 of FIG. 7 provides a symmetrical setup arrangement of microphones. This may enable a balanced stereo image to be created. As four microphones are provided this may enable a three microphone solution to be used if one of the microphones is damaged or unable to detect a signal. For instance, in some examples the apparatus 1 may be configured to detect if the user is covering one of the microphones with their fingers. In this case the apparatus 1 could follow a process for obtaining the beamed channels from three microphones.

Figure 8:
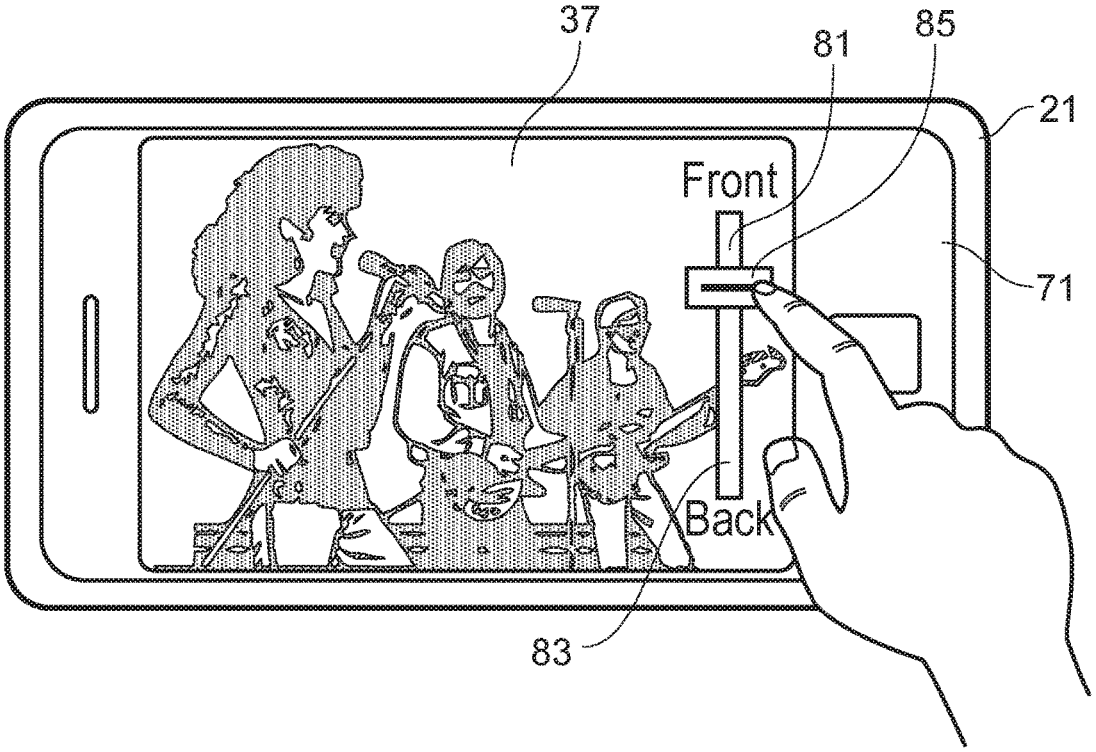
FIG. 8 illustrates an example electronic device in use.

FIG. 8 illustrates an example electronic device 21 in use. In the example of FIG. 8 the user is using the user interface 37 to control the audio focus direction and gain of an audio output.

In the example of FIG. 8 the electronic device 21 comprises a touch sensitive display on the first face 71 of the electronic device 21. The user is using the touch sensitive display to view a video stream.

A control icon 81 is displayed on the display. The control icon contains a slide bar 83 with a marker 85. The user interface 37 is configured to enable a user to control the position of the marker 85 within the slide bar 83 by making a touch input on the display. The position of the marker 85 on the slide bar 83 controls the focus position of a beamed channel. In the example of FIG. 8 the position of the marker controls the focus position relative to the front and back of the electronic device 21. The top position on the slide bar 83 corresponds to front focus with highest available gain level, and the lowest position on the slide bar 83 corresponds to back focus with highest available gain level.

In response to the detecting of the user input the apparatus 1 within the electronic device 21 may control the decoding of bit stream 57 so as to adjust the focus position of the beamed channel.

It is to be appreciated that other types of user control elements may be used in other examples of the disclosure.

In some examples the electronic device 21 may enable an adjusted audio focus setting to be stored. For instance if a user finds an audio focus setting that they like then the output corresponding to that setting could be stored in the memory circuitry 7 of the apparatus 1. In some examples the output could be stored in response to a user inputs. In some examples the output could be stored automatically every time the user adjusts the audio settings.

Examples of the disclosure enable a device 21 with two or more microphones 23 to create bit stream 57 comprising sufficient information to enable the parameters of audio focus to be controlled at the decoding phase. As a reduced size beam forming signal is used the examples of the disclosure do not increase the number of encoded audio channels which means that the amount of audio data is feasible to transmit and/or store.

Examples of the disclosure enable the original microphone signals to be encoded and the reduced beam forming signal to be added as metadata to this bit stream 57. This enables a versatile system to be provided as it enables a user to select at the decoding stage, if, when and how strongly to apply the audio focus functionality As described above, in some examples the beamed right channel may be calculated based on the reduced beamforming signal for the beamed left channel. This may enable one beamforming signal to be used to obtain two beamed channels. This reduces the computational requirements and also reduces the amount of data that needs to be transmitted and/or stored.

Examples of the disclosure do not decrease the perceived quality of the audio outputs. In some examples the perceived output quality can be adjusted based on the outputs provided by increasing or decreasing the spectrum resolution which is used to obtain the reduced size beamforming signals.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For instance in the above the described examples all of the microphones used are real microphones. In some examples the one or more of the microphones used for obtaining a beamforming signal could be a virtual microphone, that is, an arithmetic combination of at least two real microphone signals.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method comprising:

obtaining a beamforming signal using respective signals from a first microphone and a second microphone;

reducing a data size of the obtained beamforming signal by at least:

grouping the beamforming signal into frequency bands;

calculating a difference signal between a first signal from the first microphone and the beamforming signal; and computing a data value for respective frequency bands to produce the reduced data size beamforming signal using the calculated difference signal;

forming a reduced bit rate bit stream comprising at least the reduced data size beamforming signal and the first signal from the first microphone; and causing to transmit the reduced bit rate bit stream to facilitate control of parameters of audio focus associated with a beamed audio channel.

2. A method as claimed in claim 1, wherein the reduced bit rate bit stream further comprises a signal received from a third microphone.

3. A method as claimed in claim 2, further comprising at least one of:

obtaining an another beamforming signal using signals from the third microphone and a fourth microphone;

reducing a data size of the another beamforming signal by grouping the another beamforming signal into frequency bands;

computing the data value for the respective frequency bands further based upon the another beamforming signal; and adding the another reduced data size beamforming signal to the reduced bit rate bit stream.

4. A method as claimed in claim 1, wherein different sized frequency bands are used for different parts of a frequency response within the reduced data size beamforming signal.

5. A method as claimed in claim 1, wherein the reduced bit rate bit stream is formed by adding the reduced data size beamforming signal as metadata to the first signal received from the first microphone.

6. A method as claimed in claim 1, further comprising determining a difference between an audio channel signal obtained at the first microphone and the beamforming signal.

7. A method as claimed in claim 6, wherein the data value for the respective frequency bands in the reduced data size beamforming signal comprises a mean of the calculated difference signal between the audio channel signal obtained at the first microphone and the beamforming signal.

8. An apparatus comprising:

processing circuitry; and memory circuitry including computer program code, the memory circuitry and the computer program code configured to, with the processing circuitry, cause the apparatus to:

obtain a beamforming signal using respective signals from a first microphone and a second microphone;

reduce a data size of the obtained beamforming signal by at least:

grouping the beamforming signal into frequency bands;

calculating a difference signal between a first signal from the first microphone and the beamforming signal; and computing a data value for respective frequency bands to produce the reduced data size beamforming signal using the calculated difference signal;

form a reduced bit rate bit stream comprising at least the reduced data size beamforming signal and the first signal from the first microphone; and cause to transmit the reduced bit rate bit stream to facilitate control of parameters of audio focus associated with a beamed audio channel.

9. An apparatus as claimed in claim 8, wherein the reduced bit rate bit stream also comprises a signal received from a third microphone.

10. An apparatus as claimed in claim 9, wherein the memory circuitry and processing circuitry are also configured to at least one of:

obtain a further beamforming signal using respective signals from the third microphone and another microphone;

reduce a data size of the further beamforming signal by grouping the another beamforming signal into frequency bands;

compute the data value for the respective frequency bands further based upon the another beamforming signal; and add the further reduced data size beamforming signal to the reduced bit rate bit stream to enable a stereo output to be provided.

11. An apparatus as claimed in claim 8, wherein different sized frequency bands are used for different parts of a frequency response within the reduced data size beamforming signal.

12. An apparatus as claimed in claim 8, wherein the reduced bit rate bit stream is formed by adding at least one reduced data size beamforming signal as metadata to the first signal received from the first microphone.

13. An apparatus as claimed claim 8, wherein the memory circuitry and processing circuitry are also configured to:

determine a difference between an audio channel signal obtained at the first microphone and the beamforming signal.

14. An apparatus as claimed in claim 13, wherein the data value for the respective frequency bands in the reduced data size beamforming signal comprises a mean of the calculated difference signal between the audio channel signal obtained at the first microphone and the beamforming signal.

15. An apparatus as claimed in claim 8, wherein the memory circuitry and processing circuitry are also configured to:

obtain the reduced bit stream comprising at least the reduced size beamforming signal of the beamforming signal and the signal from the first microphone; and decode the reduced bit stream to obtain a first audio channel corresponding to the first signal associated with the first microphone and a beamformed audio channel.

16. An apparatus as claimed in claim 15, wherein the memory circuitry and processing circuitry are also configured to: receive a signal from a third microphone and decodes the signal received from the third microphone to enable a spatial audio signal to be rendered.

17. An apparatus as claimed in claim 15, wherein the memory circuitry and processing circuitry are also configured to: detect a user input to control at least one of:

an audio focus direction for rendering; and a gain of the beamformed audio channel.

18. A method comprising:

obtaining a reduced bit rate bit stream comprising at least a reduced data size beamforming signal and a first signal from a first microphone;

decoding the reduced bit rate bit stream to obtain a first audio channel corresponding to the first signal from the first microphone and a beamformed audio channel wherein the reduced bit rate bit stream facilitates control of parameters of audio focus associated with the beamed audio channel, wherein the reduced data size beamforming signal is derived from at least the first signal from the first microphone and a second signal from a second microphone, wherein the reduced data size beamforming signal is reduced by at least:

grouping a beamforming signal obtained using the first signal and the second signal;

calculating a difference signal between the first signal and the beamforming signal; and computing a data value for respective frequency bands to produce the reduced data size beamforming signal using the calculated difference signal; and causing to display a control element to control audio focus direction associated with the beamformed audio channel.

19. A method as claimed in claim 18, wherein obtaining the reduced bit rate bit stream further comprises receiving a signal from a third microphone and decoding the signal received from the third microphone to enable a spatial audio output to be rendered.

20. A method as claimed in claim 18, further comprising detecting a user input to control at least one of:

an audio focus direction for rendering; and a gain of the beamformed audio channel.

* * * * *